US009466304B2

(12) United States Patent
Zhang et al.

(10) Patent No.: US 9,466,304 B2
(45) Date of Patent: Oct. 11, 2016

(54) METHOD AND SYSTEM FOR DIGITAL WATERMARKING

(71) Applicants: STMicroelectronics Asia Pacific Pte Ltd, Singapore (SG); STMicroelectronics International N.V., Schiphol (NL)

(72) Inventors: Peng Zhang, Beijing (CN); Shuzheng Xu, Beijing (CN); Pengjun Wang, Beijing (CN); Sapna George, Singapore (SG); Huazhong Yang, Beijing (CN)

(73) Assignees: STMICROELECTRONICS INTERNATIONAL N.V., Schiphol (NL); STMICROELECTRONICS ASIA PACIFIC PTE. LTD., Singapore (SG)

( * ) Notice: Subject to any disclaimer, the term of this patent is extended or adjusted under 35 U.S.C. 154(b) by 0 days.

(21) Appl. No.: 14/666,109

(22) Filed: Mar. 23, 2015

(65) Prior Publication Data

US 2016/0012826 A1 Jan. 14, 2016

(30) Foreign Application Priority Data

Jul. 9, 2014 (CN) ..... 2014 1 0333164

(51) Int. Cl.
*G10L 19/018* (2013.01)

(52) U.S. Cl.
CPC ..... *G10L 19/018* (2013.01)

(58) Field of Classification Search
CPC ..... G10L 19/018
USPC ..... 704/500–504
See application file for complete search history.

(56) References Cited

U.S. PATENT DOCUMENTS

2007/0136595 A1* 6/2007 Baum ..... G10L 19/018 713/176

FOREIGN PATENT DOCUMENTS

WO WO02103695 * 12/2002 ..... G11B 20/00

OTHER PUBLICATIONS

ISO/IEC 11172-3, "Information technology—Coding of moving pictures and associated audio for digital storage media at up to about 1,5 Mbit/s—Part 3: Audio," International Standard, 1993, 158 pages.

Malvar et al., "Improved Spread Spectrum: A New Modulation Technique for Robust Watermarking," *IEEE Transactions on Signal Processing* 51(4): 898-905, Apr. 2003.

Swanson et al., "Robust audio watermarking using perceptual masking," *Signal Processing* 66:337-355, 1998.

* cited by examiner

*Primary Examiner* — Marcellus Augustin
(74) *Attorney, Agent, or Firm* — Seed IP Law Group PLLC

(57) ABSTRACT

The present invention is a system and method for digital watermarking, which discloses a system for digital watermarking, to add a watermark to an audio signal generated by a signal source. The system comprises: a spectrum modulator configured to perform spectrum modulation to a watermark bit and a pseudo noise signal to be embedded into the audio signal to generate a modulated signal; a distortion controller coupled to the signal source and the spectrum modulator and configured to shape the modulated signal based on the audio signal, so as to generate a shaped signal satisfying a predetermined distortion constraint; and an interference compensator coupled to the signal source and the distortion controller and configured to generate a compensation signal based on the audio signal, the pseudo noise signal, and the shaped signal, wherein the compensation signal is for compensating for interference to watermark decoding caused by the audio signal.

10 Claims, 3 Drawing Sheets

METHOD AND SYSTEM FOR DIGITAL WATERMARKING

BACKGROUND

1. Technical Field

The present invention generally relates to the field of digital signal processing, and more specifically, to a system and method for digital watermarking.

2. Description of the Related Art

In recent years, the digital watermarking technology has been widely applied in fields such as copyright protection of multimedia digital signals, release control, consistency check, broadcast monitoring, data hiding, etc. The basic idea of the digital watermarking technology is adding information called watermark into digital multimedia signals such as image, graph, audio and/or video, so as to be used for various verification purposes in the future. The watermark is substantively a digital signature hidden in a main multimedia signal, providing information such as proprietorship or rights of use of the main multimedia signals.

From the perspective of extraction and detection of a watermark, the watermarking technology may be divided into non-blind watermarking technology, semi-blind watermarking technology, and blind watermarking technology. Upon extract and decoding, the non-blind watermarking technology needs the original multimedia information and the added reference signals (e.g., pseudo noise sequence); upon extraction, the semi-blind watermarking technology needs a reference signal and a key for generating the reference signal; the blind watermarking technology only needs the key in the case of extraction.

In the digital watermarking technology for audio, a spread spectrum (SS)-modulated digital watermark is a known blind watermarking technology. However, the traditional SS-based watermark only considers the influence of attacking noise on watermark decoding, which ignores the interference to watermark decoding introduced by the main audio signal per se, which causes increase of the bit error rate. Moreover, in order to lower the auditory distortion caused by the watermark to main audio signals, the watermark embedding party always performs spectrum processing to the reference signals in use, such that a digital watermark decoder performing blind detection can hardly recover the reference signals used by the watermark embedding party accurately. In other words, reference signal mismatch exists between the watermark embedding party and the decoder party, which causes deterioration of the decoding performance.

Therefore, a more accurate and robust digital audio watermarking technology is needed in this field.

BRIEF SUMMARY

In order to solve the above problems and other problems in the field, the present invention provides a system and method for digital watermarking.

In one aspect of the present invention, there is provided a system for digital watermarking, the system being adapted to add a watermark to an audio signal generated by a signal source. The system comprises: a spectrum modulator configured to perform spectrum modulation to a watermark bit and a pseudo noise signal to be embedded into the audio signal to generate a modulated signal; a distortion controller coupled to the signal source and the spectrum modulator and configured to shape the modulated signal based on the audio signal, so as to generate a shaped signal satisfying a predetermined distortion constraint; and an interference compensator coupled to the signal source and the distortion controller and configured to generate a compensation signal based on the audio signal, the pseudo noise signal, and the shaped signal, wherein the compensation signal is for compensating for interference to watermark decoding caused by the audio signal.

In another aspect of the present invention, there is provided a method for digital watermarking, the method being adapted to add a watermark to an audio signal generated by a signal source. The method comprises: performing spectrum modulation to a watermark bit and a pseudo noise signal to be embedded into the audio signal to generate a modulated signal; shaping the modulated signal based on the audio signal, so as to generate a shaped signal satisfying a predetermined distortion constraint; and generating a compensation signal based on the audio signal, the pseudo noise signal, and the shaped signal, wherein the compensation signal is for compensating for interference to watermark decoding caused by the audio signal.

BRIEF DESCRIPTION OF THE SEVERAL VIEWS OF THE DRAWINGS

The above and other objectives, features and advantages of the present invention will become more comprehensible through reading the following detailed description with reference to the accompanying drawings. In the accompanying drawings, several embodiments of the present invention are illustrated in an exemplary and non-limiting manner, wherein.

In respective figures, same or corresponding reference numerals represent the same or corresponding parts.

DETAILED DESCRIPTION

Figure 1:
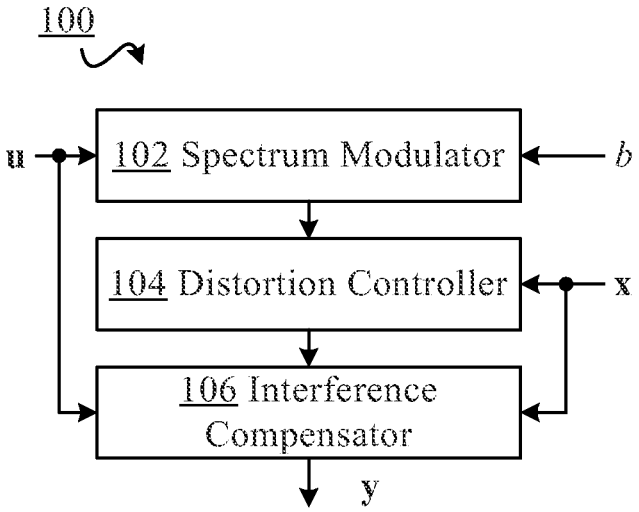
FIG. 1 shows a schematic structural block diagram of a system 100 for digital watermarking according to one exemplary embodiment of the present invention.

In general, according to the embodiments of the present invention, in order to lower the interference to watermark decoding caused by a main audio signal as a signal carrier as far as possible, a compensation signal is generated at a watermark embedding party to compensate for such interference, which may effectively reduce the bit error rate of the watermark decoding party. Moreover, in order to overcome the adverse impact on watermark decoding brought by the distortion control processing performed by the watermark embedding party to a reference signal, in the embodiments of the present invention, generation of the above compensation signal not only takes a main audio signal and an original pseudo noise signal into account, but also considers the modulated and shaped pseudo noise signal. In this way, it can be assured that the pseudo noise signal recovered at the watermark decoding party matches the embedding party, thereby further lowering the bit error rate of watermark decoding.

Hereinafter, the principle and spirit of the present invention will be described with reference to several exemplary embodiments illustrated in the drawings. It should be understood that these embodiments are provided only to enable those skilled in the art to better understand and then further implement the present invention, not intended to limit the scope of the present invention in any manner.

Please note that the term "couple" used in the following description is for limiting the connection relationships between two components. For example, "component A is coupled to component B" means component A is in connection or communication with component B through any appropriate manner. Unidirectional or bidirectional communication of signals or data may be done between two coupled components A and B. As used herein, the term "couple" refers to not only direct coupling (i.e., no further component C exists between component A and component B), but also indirect coupling (i.e., component A is coupled to a further component C, while the component C is in turn coupled to component B).

Further, in the accompanying drawings, a directional connecting line between components means to express the flow direction of information or a signal between the coupled components, not intended to limit the coupling manner between the components in any manner. Besides, in the description below, the signal may be expressed in a vector manner, which is common in the art.

Reference is first made to FIG. 1 which shows a schematic structural block diagram of a system 100 for digital watermarking according to one exemplary embodiment of the present invention.

As shown, the digital watermark system 100 comprises a spectrum modulator 102. The spectrum modulator 102 is configured to perform spectrum modulation to a pseudo noise (PN) (denoted as u) and a watermark bit (denoted as b) that is to be embedded into an audio signal (denoted as x), so as to generate a modulated signal (denoted as bu).

According to the embodiments of the present invention, the audio signal x may be generated by any appropriate one or more signal sources (not shown in FIG. 1). The signal source may be a component of the system 100 or a stand-alone component independent of the system 100. The scope of the present invention is not limited in this aspect.

The PN signal u for example may be a bit sequence with a particular number, the average value of the bits in the sequence is zero, and the value of each bit is $+\sigma_n$ or $-\sigma_n$. The PN signal may be generated by a dedicated PN generator under the control of a key. According to the embodiments of the present invention, the PN generator may be a part of the spectrum modulator 102, or a stand-alone component separate therefrom. The scope of the present invention is not limited in this aspect. For this aspect, an exemplary embodiment will be described with reference to FIG. 2.

According to the embodiments of the present invention, the spectrum modulator 102 modulates the PN signal using the watermark bit b. The watermark b is a bi-polar bit to be embedded into the audio signal x, namely, its value is equal to either +1 or −1. According to the embodiments of the present invention, the watermark bit b may be generated by a component in the system 100 or generated by other component independent of the system 100. The scope of the present invention is not limited in this aspect.

According to some embodiments of the present invention, the spectrum modulator 102 may realize spread spectrum modulation through multiplying the watermark bit b to the PN signal u, so as to generate a modulated signal bu. Other embodiments are also easily envisaged by those skilled in the art, and the scope of the present invention is not limited in this aspect.

The modulated signal bu generated by the spectrum modulator 102 is outputted to a distortion controller 104 in the system 100 to perform distortion control. As shown in FIG. 1, the distortion controller 104 is coupled to the signal source (not shown) generating the audio signal x and to the spectrum modulator 102. In operation, the distortion controller 104 may receive the audio signal x from the signal source and the modulated signal bu from the spectrum modulator 102. The distortion controller 104 is configured to shape the modulated signal based on the audio signal x, so as to generate the shaped signal satisfying the predetermined distortion constraint (denoted as $bu_p$).

It would be appreciated that after the watermark is added to the original audio signal x, the audio will be somewhat distorted in hearing. The distortion controller 104 may control thus distortion to an acceptable extent by shaping the modulated signal bu. Specifically, the distortion controller 104 may modify and adjust the spectrum features of the modulated signal bu based on features of the audio signal x, such that the shaped signal $bu_p$ satisfies a predetermined constraint in spectrum and other acoustic features. In this way, the distortion of the original audio signal caused by addition of watermark may be controlled within a limit that is unsusceptible or acceptable to the user.

Various methods of mask distortion in the audio signal under the constraint control are known in the field. For example, the distortion constraint may for example be a group of mask thresholds. The mask thresholds may be generated in an appropriate manner, for example, generated based on statistic empirical value, manual setting or through various acoustic models. As an example, masks based on acoustic psychological model may be described in detail in the embodiments described with reference to FIG. 2. Alternatively or additionally, the quantitative noise of an audio encoder for encoding the audio signals may also act as a distortion constraint. Correspondingly, the distortion controller 104 may shape the modulated signal bu, such that the power spectrum of the generated shaped signal $bu_p$ is maintained consistent with the quantitative noise of the audio encoder. Therefore, it may be guaranteed that the power of the embedded watermark bit is lower than the audio signal per se. Please note that the several distortion constraints described here are only exemplary, and any currently known or future developed distortion constrains and corresponding distortion control methods may be used in conjunction with the embodiments of the present invention.

The shaped signal $bu_p$ generated by the distortion controller 104 is fed to the interference compensator 106. As shown in FIG. 1, the interference compensator 106 in the system 100 is coupled to the signal source (not shown in FIG. 1) and the distortion controller 104. Besides, the interference compensator may also receive a PN signal u. According to the embodiments of the present invention, the interference compensator 106 is configured to generate a compensation signal (denoted as y) based on the audio signal x, PN signal u, and shaped signal $bu_p$. During generation of a resulting watermarked audio signal (denoted as s), the compensation signal is for compensating for the potential interference caused by the audio signal x to watermark decoding executed at the watermark decoding party in the future.

In the traditional SS watermarking technology, only the impact of attack noise on watermark decoding is considered, without addressing the interference caused by the main audio signal per se to watermark decoding. More specifically, in the traditional SS watermarking technology, the resultant signal s is generated computer as:

$$s=x+bu$$

However, in practice, the main audio signal is always far stronger than the attack noise because the interference to watermark decoding caused by the audio signal per se is usually dominant. In addition, since it is the modulated and shaped PN signal $bu_p$ that is used during the process of adding the watermark, the traditional SS watermarking technology cannot eliminate the impact brought by spectrum shaping on watermark decoding. In other words, the reference signal recovered at the watermark decoding party does not match the reference signal used by the watermark embedding party.

In order to solve the above problem, according to the embodiments of the present invention, in the compensation signal generated by the interference compensator 106, the interference to watermark decoding caused by the main audio signal will be eliminated at the watermark embedding party. For example, if the interference to watermark decoding caused by the main audio signal is denoted as x, then the compensation signal may be computer as:

$$y=xu_p$$

Accordingly, the final signal s may be calculated as follows:

$$s=x+\alpha bu_p-y=x+\alpha bu_p-xu_p=x+(\alpha b-x)u_p$$

wherein $\alpha$ is a parameter controlling embedding distortion. In this way, the interference x brought by the main audio signal with the watermark decoding is compensated at the embedding party. Therefore, the bit error rate of the watermark decoding party can be effectively lowered.

Moreover, it may be seen that when calculating the main audio signal interference x, the interference compensator 106 not only considers the features of the main audio signal x and the PN signal u, but also considers the main signal component $u_p$ of the shaped signal $bu_p$ (namely, the remaining signal component after the watermark bit b is removed from $bu_n$). In this way, the impact brought by the spectrum shaping executed for the purpose of distortion control on watermark decoding may also be effectively compensated. The value of interference x may be calculated in various appropriate manners. Hereinafter, a specific example will be described with reference to FIG. 2.

Figure 2:
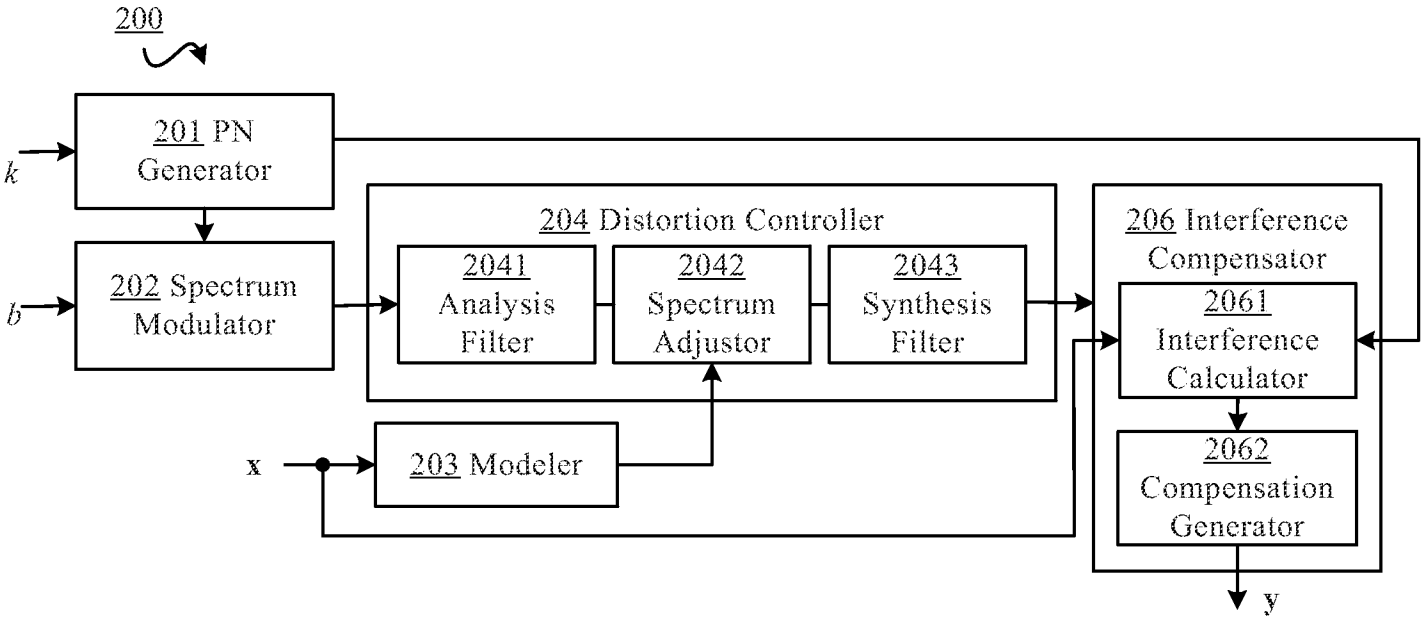
FIG. 2 shows an exemplary structural block diagram of a system 200 for digital watermarking according to another exemplary embodiment of the present invention.

Now, refer to FIG. 2, in which an exemplary structural block diagram of a system 200 for digital watermarking according to another exemplary embodiment of the present invention is presented. It may be understood that the system 200 may be regarded as a specific example of the system 100 as described above with reference to FIG. 1.

As shown in FIG. 2, the system 200 comprises a pseudo noise (PN) generator 201 coupled to a spectrum modulator 202 and an interference compensator 206 (more specifically, an interference calculator 2061 in the interference compensator 206). During operation, the pseudo noise generator 201 may generate a pseudo noise signal u under the control of one key k, and the generated pseudo noise signal u is fed back to the spectrum modulator 202 and the interference compensator 206. The pseudo noise generator 201 may generate a pseudo noise signal in any currently known or future developed manners, and the scope of the present invention is not limited in this aspect.

The system 200 may further comprise a spectrum modulator 202, which corresponds to the spectrum modulator 102 in the system 100. As shown in the figure, the spectrum controller is coupled to the pseudo noise generator 201 and configured to receive a pseudo noise signal u generated by the pseudo noise generator 201. Next, the spectrum modulator 202 modules the pseudo noise signal u and the to-be-embedded watermark bit b to generate a modulated signal bu. According to the embodiments of the present invention, the spectrum modulator 202 may accomplish the modulation by multiplying the pseudo noise signal u with the watermark bit b. Of course, other manners are also feasible. The scope of the present invention is not limited in this aspect.

The modulated signal bu generated by the spectrum modulator 202 is fed to the distortion controller 204 in the system 200 (which corresponds to the distortion controller 104 in the system 100). In particular, in the embodiment of FIG. 2, the distortion controller 204 comprises an analytical filter 2041 configured to transform the modulated signal bu generated by the spectrum controller 202 into a set of spectrum coefficients in the frequency domain. This spectrum transform, for example, may be implemented based on the Fast Fourier Transform (FFT). Those skilled in the art may easily contemplate other appropriate manners, and the scope of the present invention is not limited in this aspect.

The spectrum system resulting from transform by the analysis filter 2041 is fed to the spectrum adjustor 2042 in the distortion controller 204. The spectrum adjustor 2042 is coupled to the analysis filter 2041 and configured to regulate the spectrum coefficients generated by the analysis filter 2041 based on the predetermined distortion constrain. As mentioned above, the distortion constrain may be derived through various manners. In the example shown in FIG. 2, the distortion constraint may be generated by a modeler 203.

Specifically, as shown in FIG. 2, the system 200 comprises a modeler 203 coupled to a signal source generating a main audio signal x (not shown in the figure) and a spectrum adjustor 2042. The modeler 203 is configured to process the audio signal x based on a psychoacoustic model so as to generate a masking threshold. In this art, various methods for generating a masking threshold for an audio signal are known in the art, e.g., c.f. M. Swanson et al., "Robust audio watermarking using perceptual masking," Signal Processing, vol. 66, pp. 337-355, 1998. Actually, various methods for masking hearing distortion in an audio signal may be used in conjunction with the embodiments of the present invention, and the scope of the present invention is not limited in this aspect.

The masking threshold generated by the modeler 203 is fed to the spectrum adjustor 2042 as a distortion constraint. Correspondingly, the spectrum adjustor 2042 may regulate the spectrum coefficients to be lower than the masking threshold. Besides, the spectrum adjustor 2042 may also consider various other factors, e.g., quantitative noise of the audio encoder and the like, when adjusting the spectrum coefficient.

The spectrum coefficients regulated by the spectrum adjustor 2042 are fed to a synthesis filter 2043 in the distortion controller 204. The synthesis filter 2043 is coupled to the spectrum adjustor 2042 and configured to transform the regulated spectrum coefficients back to the time domain. For example, when the analysis filter completes the frequency domain transform using FFT, the synthesis filter 2043 may perform the time domain transform using the Inverse Fast Fourier Transform. Of course, other manners are also feasible, and the scope of the present invention is not limited in this aspect. The temporal signal generated by the synthesis filter 2043 is fed as the shaped signal $bu_p$ from the distortion controller 204 to the interference compensator 206.

Still with reference to FIG. 2, the system 200 further comprises an interference compensator 206, which corresponds to the interference compensator 106 in the system 100. In the embodiment shown in FIG. 2, the interference compensator 206 comprises an interference calculator 2061 configured to calculate a value of interference x to watermark decoding caused by the audio signal based on the main audio signal x, pseudo noise signal u, and shaped signal $bu_p$.

As an example, according to some embodiments, the interference calculator 2061 may calculate the value of interference x through calculating a signal projection. One feasible manner is calculating x as such:

$$x=\langle x,u\rangle/\langle u,u\rangle$$

where <,> denotes an internal product between two vectors. In this case, the physical meaning of x is the projection of the audio signal x on the PN signal u. However, as mentioned above, in order to control the distortion of the original audio x within an acceptable scope, the original PN signal experiences modulation and shaping. In this way, the watermark decoding party always cannot accurately recover the reference signal $bu_p$ used by the watermark embedding party.

Therefore, according to the preferred embodiment of the present invention, the value of interference x to watermark decoding caused by the audio signal may be calculated as such:

$$x=\langle x,u\rangle/\langle u_p,u\rangle$$

In this way, by considering the main signal component of the shaped signal when calculating the value of interference x, the problem existing in the prior art can be effectively overcome, which guarantees that the reference signal extracted by the watermark decoding party is consistent with the watermark sequence embedded by the watermark embedding party.

Return to FIG. 2. The interference compensator 206 further comprises a compensation generator 2062 coupled to the interference calculator 2061 and configured to generate a compensation signal y based on the value of interference x and the main signal component of the modulated signal. For example, in some embodiments, the compensation signal y may be calculated as $y=xu_p$. When the final watermark signal s is generated, y is used to compensate for the interference caused by the audio signal x to watermark decoding executed by the watermark decoding party. For example, based on the embodiments of the present invention, the watermarked audio signal s may be calculated as:

$$s=X+\alpha bu_p-xu_p=X+(\alpha b-x)u_p$$

where $\alpha$ is a parameter for controlling distortion, and an appropriate numerical value may be set according to the actual conditions.

Examples of a system for digital watermarking according to some embodiments of the present invention have been described above with reference to FIG. 1 and FIG. 2. According to the embodiments of the present invention, the interference to watermark decoding caused by the main audio signal is taken into consideration, and the embedding party of the watermark has compensated for such interference in advance. Therefore, the interference to future watermark decoding the main audio signal as a carrier can be eliminated more effectively. In particular, when generating a compensation signal, not only the main audio signal and the original PN signal are considered, the impact of the spectrum shaping for distortion control on the PN signal is also considered. In this way, the mismatch between the watermark decoding party and the watermark embedding party may be eliminated in the aspect of reference signal, which further lowers the bit error rate.

It should be understood that the particular details and algorithms as described above are all exemplary, and based on the teaching and inspiration provided here, those skilled in the art would easily conceive of an alternative solution to realize the above idea. These alternative solutions all fall within the scope of the present invention.

The systems described above with reference to FIGS. 1 and 2 may be implemented using various manners. For example, in some embodiments, the system may be implemented as an integrated circuit (IC) chip or an application-specific integrated circuit (ASIC) chip. The controller may also be realized as a system on chip (SOC), a field programmable gate array (FPGA), etc. In particular, respective components included in the system may also be integrated onto a single chip or separately encapsulated in stand-alone chips or devices, and the scope of the present invention is not limited in this aspect. Actually, all devices and manners existing or future developed may be used to perform various embodiments of the present invention.

Figure 3:
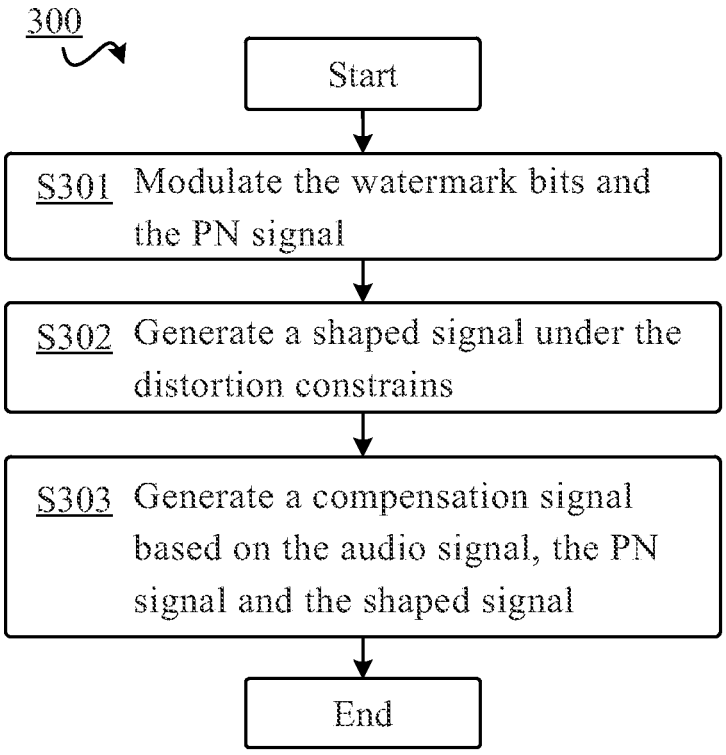
FIG. 3 shows a flowchart of a method 300 for digital watermarking according to one exemplary embodiment of the present invention.

FIG. 3 shows a flowchart of a method 300 for digital watermarking according to one exemplary embodiment of the present invention.

As shown in the figure, after the method 300 starts, in step S301, spectrum modulation is performed to a watermark bit b to be embedded into the audio signal and a pseudo noise signal u to generate a modulated signal bu. According to some embodiments of the present invention, the pseudo noise signal, for example, is generated under the control of a key.

Next, the method 300 proceeds to step S302, in which the modulated signal bu is shaped based on the audio signal x to generate a shaped signal $bu_p$ satisfying a predetermined distortion constrain. According to some embodiments, generating a shaped signal $bu_p$ may comprise: transforming the modulated signal bu into spectrum coefficients in a frequency domain; adjusting spectrum coefficients based on a distortion constraint, and transforming the regulated spectrum coefficients back into the time domain to generate the shaped signal $bu_p$. According to some embodiments of the present invention, the distortion constrain may be a masking threshold generated based on psychoacoustic model specifically for the audio signal x.

The method 300 then proceeds to step S303 in which a compensation signal is generated based on the audio signal x, the pseudo noise signal u, and the shaped signal $bu_p$. The generated compensation signal will be used for compensating for the interference to the watermark decoding caused by the audio signal x. According to some embodiments of the present invention, generating a compensation signal comprises: calculating a signal projection based on the audio signal x, the pseudo noise signal u, and the shaped signal $bu_p$, to determine a value of interference x to watermark decoding caused by the audio signal; and generating the compensation signal based on the value of interference x and the modulated signal component.

It should be understood that the method 300 may be executed by the system 100 and/or 200 as described above. Therefore, all features described above with reference to FIGS. 1 and 2 are likewise applicable to the method 300, which will not be detailed here. Moreover, the steps shown in FIG. 3 are only schematic. For example, these steps may be performed in different ordering or even in parallel. Additionally, for the method 300 additional steps may be added, some steps may be replaced or even omitted.

The devices and their modules related to in the present invention may be implemented by, for example, a very large scale integrated circuit or gate array, a semiconductor such as a logic chip, a transistor, or hardware circuitry of a programmable hardware device such as a field programmable gate array, a programmable logic device, etc. Alternatively or additionally, the embodiments of the present invention may also be implemented through firmware.

It should be noted that although several modules or sub-modules of the devices have been described in detail, such partitions are only non-compulsory. Actually, according to the embodiments of the present invention, features and functions of two or more devices as described above may be substantiated in one device. In turn, the features and functions of one device as described above may be further partitioned into multiple devices to substantiate.

Besides, although the operations of the method of the present invention have been described in particular ordering in the drawings, it does not require or suggest that these operations have to be performed in that particular ordering, or a desired result can only be reached by performing all illustrated operations. On the contrary, the steps described in the flowchart may be changed in their execution orders. Additionally or alternatively, some steps may be omitted; a plurality of steps may be combined into one step for execution, and/or one step may be decomposed into a plurality of steps for execution.

Although the present invention has been described with reference to several preferred embodiments, it should be understood that the present invention is not limited to the disclosed preferred embodiments. The present invention intends to cover various modifications and equivalent arrangements within the spirit and scope of the appended claims. The scope of the appended claims satisfies a broadest explanation and therefore includes all such modifications and equivalent structures and functions.

We claim:

1. A system comprising:

a signal source configured to generate an audio signal; and an integrated circuit coupled to the signal source, the integrated circuit configured to add a watermark to the audio signal, the integrated circuit including:

a spectrum modulator configured to perform spectrum modulation on a watermark bit and a pseudo noise signal to be embedded into the audio signal to generate a modulated signal;

a distortion controller coupled to the signal source and the spectrum modulator and configured to shape the modulated signal based on the audio signal to generate a shaped signal satisfying a predetermined distortion constraint;

an interference compensator coupled to the signal source and the distortion controller and configured to generate a compensation signal based on the audio signal, the pseudo noise signal and the shaped signal; and a signal generator configured to generate a watermarked audio signal based on the compensation signal, the shaped signal and the audio signal.

2. The system according to claim 1, further comprising:

a pseudo noise generator coupled to the spectrum modulator and the interference compensator and configured to generate the pseudo noise signal under control of a key and to feed the pseudo noise signal to the spectrum modulator and the interference compensator.

3. The system according to claim 1, wherein the distortion controller comprises:

an analysis filter configured to transform the modulated signal into spectrum coefficients in a frequency domain;

a spectrum adjustor coupled to the analysis filter and configured to adjust the spectrum coefficients based on the distortion constraint; and a synthesis filter coupled to the spectrum adjustor and configured to transform the adjusted spectrum coefficients back into a time domain to generate the shaped signal.

4. The system according to claim 1, further comprising:

a modeler coupled to the signal source and the distortion controller and configured to generate a masking threshold for the audio signal based on a psychoacoustic model and to feed the masking threshold as the distortion constraint to the distortion controller.

5. The system according to claim 1, wherein the interference compensator comprises:

an interference calculator configured to calculate a signal projection based on the audio signal, the pseudo noise signal and the shaped signal to determine a value of interference to the watermark decoding caused by the audio signal; and a compensation generator coupled to the interference calculator and configured to generate the compensation signal based on the value of interference and the modulated signal.

6. A method for digital watermarking, the method comprising:

generating a modulated signal in a spectrum modulator by embedding a watermark bit and a pseudo noise signal into an audio signal;

generating a shaped signal satisfying a predetermined distortion constraint in a distortion controller by shaping the modulated signal based on the audio signal;

generating a compensation signal in an interference compensator based on the audio signal, the pseudo noise signal and the shaped signal; and generating a watermarked audio signal in a signal generator based on the compensation signal, the shaped signal and the audio signal.

7. The method according to claim 6, further comprising:

generating the pseudo noise signal under control of a key in a pseudo noise generator.

8. The method according to claim 6, wherein generating the shaped signal satisfying the predetermined distortion constraint in the distortion controller by shaping the modulated signal based on the audio signal comprises:

transforming the modulated signal into spectrum coefficients in a frequency domain in an analysis filter;

adjusting the spectrum coefficients based on the distortion constraint in a spectrum adjustor; and generating the shaped signal by transforming the adjusted spectrum coefficients back into a time domain in a synthesis filter.

9. The method according to claim 6, further comprising:

generating a masking threshold for the audio signal in a modeler based on a psychoacoustic model as the distortion constraint.

10. The method according to claim 6, wherein generating the compensation signal based on the audio signal, the pseudo noise signal and the shaped signal comprises:

calculating a signal projection in an interference calculator based on the audio signal, the pseudo noise signal and the shaped signal to determine a value of interference to the watermark decoding caused by the audio signal; and generating the compensation signal in a compensation generator based on the value of interference and the modulated signal.

* * * * *